United States Patent [19]

McClure

[11] Patent Number: 4,681,372

[45] Date of Patent: Jul. 21, 1987

[54] DEEP SEA MINING APPARATUS

[76] Inventor: William L. McClure, 204 40th St., Virginia Beach, Va. 23451

[21] Appl. No.: 828,265

[22] Filed: Feb. 11, 1986

[51] Int. Cl.[4] ..... E02F 3/88; E02F 7/00

[52] U.S. Cl. ..... 299/8; 37/61; 37/DIG. 8; 417/183

[58] Field of Search ..... 37/61, 62, DIG. 8; 417/78, 84, 178, 183; 299/8

[56] References Cited

U.S. PATENT DOCUMENTS

| | | | |
|---|---|---|---|
| 86,152 | 1/1869 | Hancock . | |
| 105,056 | 7/1870 | Eads | 37/61 |
| 466,213 | 12/1891 | Beard | 417/183 |
| 763,720 | 6/1904 | Campbell . | |
| 1,459,153 | 6/1923 | Griesemer . | |
| 1,729,577 | 9/1929 | Gastell . | |
| 2,019,968 | 11/1935 | Holloway | 37/62 |
| 2,044,038 | 6/1936 | Lord | 103/262 |
| 2,191,424 | 2/1940 | Cardinal | 37/61 X |
| 2,399,249 | 4/1946 | Perignat | 417/183 |
| 2,604,867 | 7/1952 | Frye | 417/84 |
| 2,711,598 | 6/1955 | Craggs, Jr. | 37/62 |
| 2,888,191 | 5/1959 | Neumann et al. | 417/183 X |
| 3,010,232 | 11/1961 | Skakel et al. | 37/195 |
| 3,213,807 | 10/1965 | Ramsden et al. | 103/262 |
| 3,413,038 | 11/1968 | Frazier | 302/14 |
| 3,456,371 | 7/1969 | Graham et al. | 37/195 |
| 3,672,725 | 6/1972 | Johnson | 37/DIG. 8 |
| 3,673,716 | 7/1972 | Trondle | 37/61 |
| 3,688,511 | 9/1972 | Harmstrof | 61/72.4 |
| 3,765,727 | 10/1973 | Santangelo et al. | 302/14 |
| 3,971,593 | 7/1976 | Porte et al. | 299/8 |
| 4,060,355 | 11/1977 | Walz et al. | 425/7 |
| 4,070,061 | 1/1978 | Obolensky | 37/61 X |
| 4,165,571 | 8/1979 | Chang et al. | 37/62 |
| 4,296,970 | 10/1981 | Hodges | 299/67 |
| 4,368,923 | 1/1983 | Handa et al. | 299/8 |

FOREIGN PATENT DOCUMENTS

| | | | |
|---|---|---|---|
| 3234370 | 3/1984 | Fed. Rep. of Germany | 440/38 |

OTHER PUBLICATIONS

"The Case for Deep Ocean Mining", American Mining Congress, Washington, D.C.

"Deep Seabed Mining", U.S. Department of Commerce, National Oceanic and Atmospheric Administration, Dec. 1983.

*Primary Examiner*—Clifford D. Crowder

*Attorney, Agent, or Firm*—Alfred J. Mangels

[57] ABSTRACT

An undersea mining apparatus including a hydraulically operated ejector pump for submerged use to provide a reduced pressure adjacent the outlet of a lift pipe, to thereby induce flow of mineral nodules from the ocean floor through the pipe. The jet flow is provided by an annular jet defined between the outlet of the lift pipe and the inlet of a dredge pipe that includes a converging-diverging venturi therewithin. The venturi is movable relative to the outlet of the lift pipe to adjust the area of the annulus defined therebetween, and thereby permit variation of the rate of flow of pressurized water and of mineral nodules therethrough.

16 Claims, 7 Drawing Figures

DEEP SEA MINING APPARATUS

BACKGROUND OF THE INVENTION

1. Field of the Invention

The present invention relates to deep sea mining apparatus for recovering minerals from the ocean floor, and more particularly to deep sea mining apparatus wherein a high velocity water jet is provided to cause an upward flow through a dredge pipe of nodular materials found on the ocean floor.

2. Description of the Prior Art

Within the past 25 years or so, it has been discovered that the sea bed contains a large quantity of metallic and mineral materials, some of which are in the form of nodules that are of irregular shape and resemble potatoes in size and shape. A particularly high concentration of such nodules is found in the east-central Pacific Ocean at depths of approximately 15,000 feet. Such nodules have a high percentage of valuable metals, such as nickel, cobalt, manganese, and copper. For example, nodules have been found in that are that have approximately 1.3% nickel, approximately 1.1% copper, approximately 0.2% cobalt, and approximately 25% manganese. It is estimated that by utilizing ocean mining of such nodules, the United States could become self sufficient with respect to its needs for both cobalt and manganese, rather than having to import over 90% of those materials as at present, and that it could be self sufficient to the extent of meeting from about 70% to about 90% of its current needs for nickel and copper. Thus there is substantial economic interest in utilizing deep sea mining to obtain the benefits of the vast untapped resources in the sea of the metals identified above.

Previously-disclosed technqiues for obtaining manganese nodules from the ocean floor have involved the use of compressed air or compressed gas for generating a flow of water in a pipe to draw the nodules upwardly from the ocean floor to a suitable mining ship. For example, in U.S. Pat. No. 3,456,371, which issued on July 22, 1969, to J. R. Graham et al, there is disclosed a remotely controlled gathering vehicle, or tractor, having scraper blades and a collector head. The gathering vehicle is remotely controlled from a mining ship and traverses the ocean floor to gether and collect manganese nodules. The disclosed apparatus includes a source of compressed air, which is injected into a dredge pipe at a point below the surface of the ocean to generate an upward flow of water within the pipe.

U.S. Pat. No. 3,765,727, which issued Oct. 16, 1973, to Joseph G. Santangelo et al, discloses a deep sea mining apparatus that also utilizes the injection of compressed air into a dredge conduit to cause an upward flow of water in the conduit. A submerged nozzle is provided adjacent the ocean floor, and is connected to a suitable dredge pipe that is in communication with the mining vessel. The compressed air is introduced at a point below the surface of the water in order to induce an upward flow in the dredge pipe.

U.S. Pat. No. 3,971,593, which issued July 27, 1976, to Robert Porte et al, shows a deep sea mining apparatus wherein a movable collecting vehicle is provided that moves along the sea floor. A submerged underwater station is in communication with the collecting vehicle and includes a power unit and a storage zone for collected nodules. The underwater station also includes means for providing a compressed gas that is forced into the dredge pipe, again to induce an upward flow therein of material from the ocean floor.

The deep seam mining technique disclosed in the above-identified patents each involve the injection of a compressed gas into a dredge pipe. Thus suitable gas compression apparatus is required. However, the use of compressed gas complicates the mining process because the lifting pipe is subjected to three different materials—gas, water, and manganese nodules and other solids, all of which can cause process instability. Additionally, a large diameter dredge pipe is required, and the pipe must increase in diameter as the surface of the water is approached to permit expansion of the air as it approaches the surface. It is therefore desirable to provide an apparatus that does not require a large diameter dredge pipe that increases in diameter by tapering outwardly in an upward direction.

SUMMARY OF THE INVENTION

Briefly stated, and in accordance with one aspect of the present invention, an undersea mining apparatus is provided for recovering particulate matter on the ocean floor. The apparatus includes a conduit for conveying particulate material in the form of nodules from the ocean floor to a surface vessel. The conduit includes a lift pipe having an inlet end that is adapted to be positioned adjacent the ocean floor and an outlet end, and that can be connected with a suitable collecting means, and a dredge pipe having an inlet end adjacent the outlet end of the lift pipe and having an outlet end that is spaced from the dredge pipe inlet end and including a discharge opening to discharge collected nodules into a surface vessel. Pressurizing means are included for providing a source of pressurized water, the pressurized water being provided to a lifting means and introduced into the conduit. The lifting means is in communication with the pressurizing means and the conduit means. The lifting means provides a lifting jet of pressurized water to induce a flow through the dredge pipe and cause the nodules to travel through the lift piper and the dredge pipe. The lifting means includes a lifting chamber that surrounds the dredge pipe inlet at a desired height above the sea floor and the lift pipe outlet, which is adjacent and in communication with the dredge pipe inlet. The lift pipe outlet and the dredge pipe inlet are movable axially relative to each other. The dredge pipe includes a venturi having a converging section, a throat section, and a diverging section, each of which are in axial alignment to provide an axially-symmetric converging-diverging venturi. The lift pipe outlet extends into the converging section of the venturi to define an annulus area therewith, the annulus area being in communication with the lifting chamber to permit pressurized water to pass through the annulus area to cause lifting of the nodules through the conduit means to the surface vessel.

DESCRIPTION OF THE PREFERRED EMBODIMENTS

Figure 1:
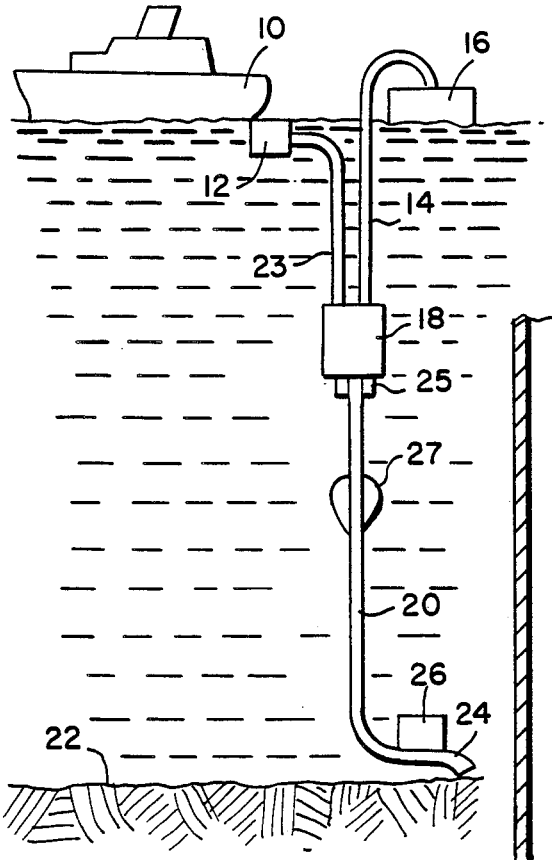
FIG. 1 is a schematic view showing a surface ship and associated equipment to enable undersea mining of mineral nodules to be conducted in accordance with the present invention.
Figure 4:
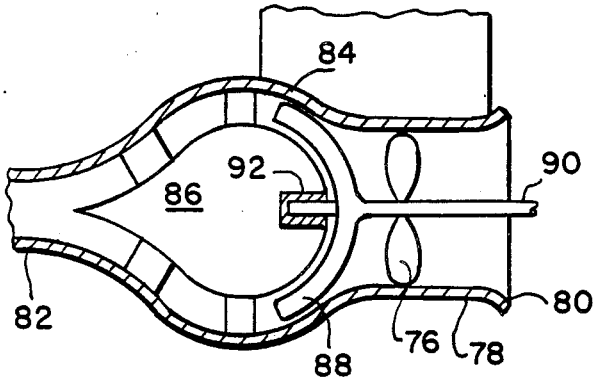
FIG. 4 is a fragmentary sectional view of one form of water pumping device utilizing a standard ship propeller and drive shaft to permit use of the ship engine for providing pressurized water to a lifting nozzle in accordance with the present invention.

Referring now to the drawings, and particularly to FIG. 1 thereof, there is shown an ocean mining ship 10 that includes water pumping means 12 that is connected to the ship propeller (see FIG. 4). A submerged dredge pipe 14 is provided and extends from a collection barge 16 to a predetermined depth below the surface of the water, and terminates in a lifting or jet pumping chamber 18. A lift pipe 20 extends from jet pumping chamber 18 to the ocean floor 22, and terminates in a suitable collection device 24. A pressurizing conduit 23 extends from pumping means 12 to jet pumping chamber 18. As shown in FIG. 1, an instrument platform 26, or the like, can be provided to permit the carrying of lights, television cameras, and the like, to observe the ocean floor and permit the determination of the optimum sites for mining to provide the greatest volume of minerals. Additionally, a pair of floats 25, 27 are provided to support the dredge pipe and the lift pipe in a substantially vertical orientation below the surface of the water.

In the overall operation of the present system as hereinabove described, the water pumping means 12 is driven from the ship engine drive shaft to provide a large volume of water under pressure, and the water is conveyed through pressurizing conduit 23 to jet pumping chamber 18. The water is introduced into dredge pipe 14, as will hereinafter be described, to induce a flow within lift pipe 20 of water and minerals from the ocean floor to permit recovery of the minerals by conveying them to collection barge 16. A water jet is provided to induce the upward flow of minerals through lift pipe 20 and into dredge pipe 14 by generating a low pressure area adjacent the upper end of lift pipe 20 within jet pumping chamber 18, whereupon the higher water pressure at the ocean floor results in a pressure differential between the upper and lower ends of lift pipe 20 to cause a flow of material upwardly in lift pipe 20, and the suction effect provided at the lower end of lift pipe 20 by that flow serves to draw mineral nodules into lift pipe 20 for conveyance to collection barge 16.

Figure 2:
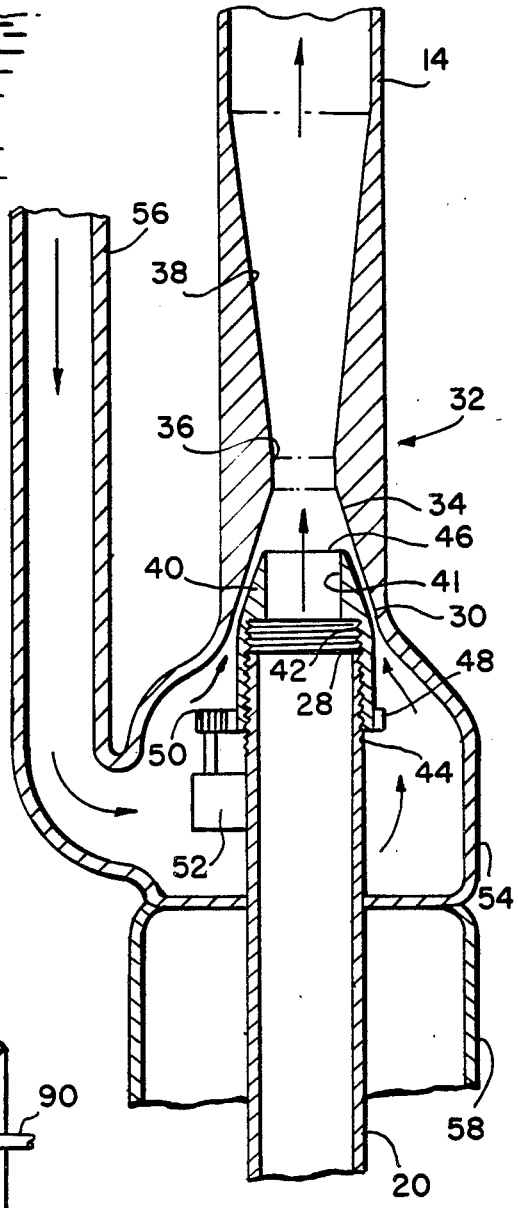
FIG. 2 is an enlarged fragmentary sectional view of a lifting chamber that includes a threaded annular collar connected to a lift pipe, and which is motor driven to permit adjustment of the position thereof relative to a venturi in accordance with the present invention.

The preferred pumping arrangement is illustrated in FIG. 2, which shows a water jet pump provided by means of an annular water jet that surrounds the upper end of lift pipe 20. Lift pipe 20 terminates in an upwardly facing outlet opening 28, and in the embodiment illustrated the diameter of the lift pipe is approximately 20 inches. Spaced above and adjacent upper end 28 of lift pipe 20 is dredge pipe 14, which has a downwardly facing opening 30 that surrounds the upper end of lift pipe 20, and which conveys the lifted material to collection barge 16 (see FIG. 1). Dredge pipe 14 includes a venturi 32 that has a converging section 34 defined by an upwardly and inwardly sloping surface that defines an included angle of approximately 30°, and terminates inwardly at the upstream end of a cylindrical throat section 36 having a diameter of about 14.6 inches and an axial length of about 20 inches. A gradually diverging section 38 extends from the downstream end of throat section 36 at an included angle of about 15° and terminates at the inner diameter of dredge pipe 14, which is approximately 30 inches in diameter. Preferably, the flow ara at throat section 36 of the venturi is about one half the flow area at the outlet opening 28 of lift pipe 20.

The downstream end of lift pipe 20 carries an annular collar 40 that has an inner diameter 41 substantially equal to the inner diameter of lift pipe 20 and inludes internal threads 42 to engage with corresponding external threads 44 formed along the upper cylindrical end of lift pipe 20. Although threads 42, 44 can have any desired configuration and pitch, an arrangement whereby eight threads per inch is provided is believed to be satisfactory. The downstream outer surface of collar 40 is tapered to define an included angle of about 24°. Annular collar 40 is rotatable relative to lift pipe 20 to move the downstream opening 46 of collar 40 into or out of converging section 34 of venturi 32. Rotation of collar 40 relative to lift pipe 20 permits axial movement of collar 40 to provide adjustment of the size of the annular gap between the downstream end of collar 40 and converging section 34 of the venturi, and can be accomplished by a geared connection, wherein collar 40 includes an external ring gear 48 that meshingly engages with a pinion 50 driven by a drive motor 52, which is remotely operable from the ocean mining ship (not shown in FIG. 2). One such way of driving and controlling the position of the collar is by means of a synchro transmitter on the ship and a synchro receiver at the collar to control the rotation thereof.

Surrounding the upper, downstream end of lift pipe 20 is a plenum chamber 54 that is in communication with the source of pressurized water by means of a suitable pressure conduit 56. A chamber 58 surrounding the lift pipe and immediately below plenum chamber 54 can serve as a float to support the lift pipe.

In operation, high pressure water flows from the ship through pressure conduit 56 to plenum chamber 54, and then through the annular gap between collar 40 and the inner surface of converging portion 34 of the venturi. The annular gap defines a reduced cross-sectional area to provide an annular water jet that flows past upper opening 46 of collar 40 at a high velocity, to thereby cause a reduced pressure zone at the downstream end of lift pipe 20 and thereby induce flow through lift pipe 20 by ejector action. The reduced pressure zone adjacent the end of the lift pipe causes flow from the ocean floor to take place through lift pipe 20, by virtue of the pressure differential resulting from the higher pressure that exists at the ocean floor, and thereby water, mineral nodules, and other materials are drawn into lift pipe 20 and conveyed therethrough and through ventuir 32 and dredge pipe 14 into the collection barge.

Figure 3:
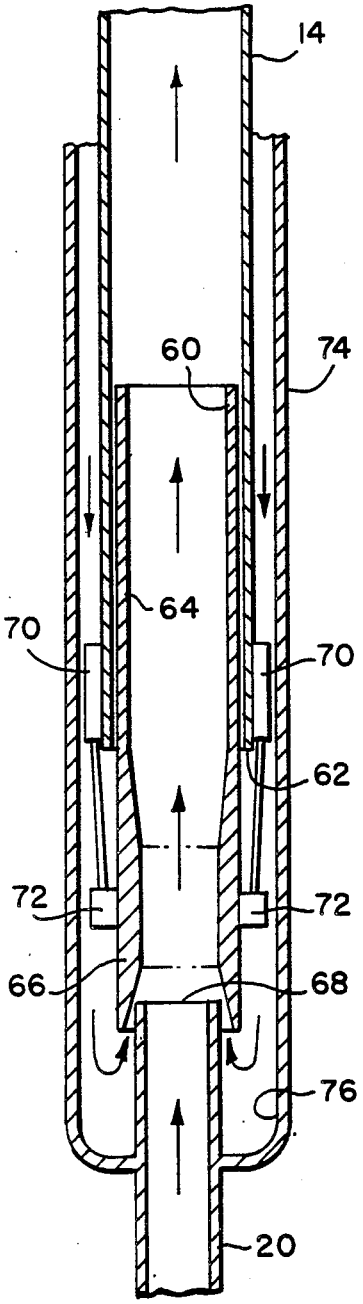
FIG. 3 is a fragmentary sectional view similar to FIG. 2, but showing hydraulic actuator means for moving a venturi relative to a lift pipe outlet.

An alternative structural arrangement for accomplishing the axial spacing adjustment between collar 40 and venturi 32 in dredge pipe 14 is illustrated in FIG. 3. As therein shown, dredge pipe 14 includes an inner tubular sleeve 60 that extends outwardly from the inlet 62 of dredge pipe 14. Sleeve 60 includes a cylindrical portion 64 at its downstream end, and a converging-diverging venturi portion 66 at its upstream end. The sizes of the respective sections of the venturi can be the same as those of the embodiment of FIG. 2. Lift pipe 20 includes a fixed discharge opening 68, and, as shown, pipe 20 extends into the converging portion of venturi 66 for a predetermined distance. Hydraulic actuators 70 are provided on each side of the dredge pipe and have the cylinder portions thereof secured to the outer surface of dredge pipe 14, and the rod portions thereof are connected to outwardly extending ears can that are carried by sleeve 60. Ears 72 can pass through and along elongated, axially extending slots (not shown) in the lower portion fo dredge pipe 14, and actuation of the actuators by hydraulic pressure moves sleeve 60 and venturi 66 axially relative to outlet 68 of lift pipe 20, thereby permitting adjustment of the annulus area defined between the outlet end 68 of lift pipe 20 and the converging section of venturi 66. An enclosing conduit 74 is provided outwardly of and in concentric relationship with dredge pipe 14 to serve as an annular passageway therebetween to convey and introduce pressurized water to a plenum chamber 76 surrounding the lower end of dredge pipe 14, from which the pressurized water flows between the upper end of lift pipe 20 and the converging portion of the venturi to thereby induce a reduced pressure at the opening 68 of lift pipe 20 and causes flow to take place therethrough.

The pressurized water that is provided to flow through the annulus in the jet pumping chamber can be provided by a separate water pump of any suitable configuration, although it is preferred that the propeller of the ocean mining ship by utilized for that purpose. Referring to FIG. 4, the standard ship propeller 76 is illustrated and is surrounded by duct 78 having a bell-mouth opening 80, and having a discharging opening 82 at the downstream end of the duct. Between openings 80 and 82 the duct side wall portions 84 thereof flare outwardly and define an annular passageway with a central body 86 and receives an auxiliary pump impeller 88, which is of modifed form, to provide additional pumping. Each of propeller 76 and impeller 88 is mounted on the main ship drive shaft 90, and the outboard end of shaft 90 is supported in a suitable journal bearing 92. Use of the ship propeller, whether with or without an additional impeller and through the ship power plant (not shown), provides a self-contained source of high power to operate the water pumping arrangement, to thereby obviate the need for an additional pump, and also to provide sufficient pumping capacity to provide high water flow at a high pressure within the plenum of the jet pumping chamber.

Figure 5:
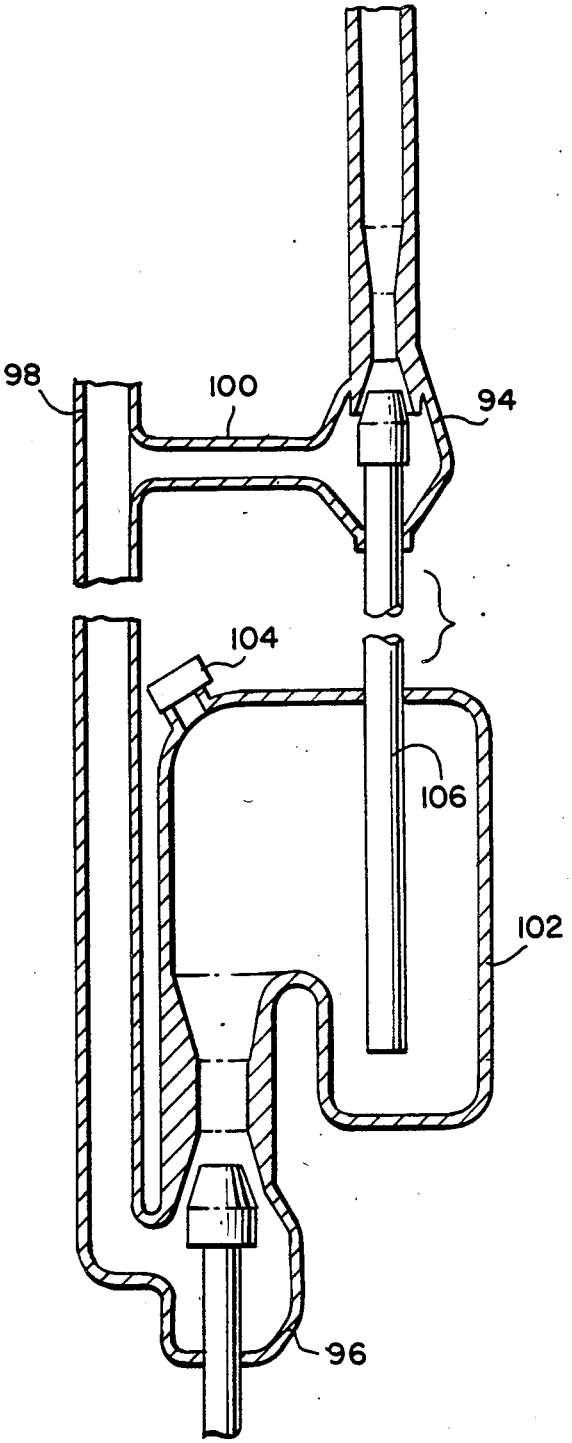
FIG. 5 is a fragmentary sectional view illustrating another embodiment in accordance with the present invention, wherein a two stage pumping arrangement is provided.

Referring now to FIG. 5, there is shown a diagrammatical view of a two stage pumping arrangement, wherein the first stage pumping chamber 94 is positioned at approximately the 1,000 foot level below the surface of the ocean, and the second stage pumping chamber 96 is provided at approximately the 2,000 foot level below the surface of the ocean. A high pressure water stream is provided through a common conduit 98 having a first branch 100 that extends to the first stage jet pumping chamber 94, and terminates at the second stage jet pumping chamber 96. The outlet from second stage 96 is connected with a settling tank 102, which can include, for example, a synchro-controlled pressure control valve 104 to permit release therethrough of excess pressurized water. Settling tank 102 is in communication with first stage pumping chamber 94 by means of an inlet pipe 106. In this particular arrangement, the principal pumping action would be provided by second stage 96, and first stage 94 is provided for additional pumping capacity, if needed. In that regard, a suitable control valve (not shown) can be positioned between pressure conduit 98 and first stage pumping chamber 94 to control the flow of pressurized water therethrough.

Collection device 24 can be in the form of an elongated opening that has its larger dimension extending in a direction perpendicular to the direction of movement of the collection device along the ocean floor. The opening can be defined by an outwardly flaring nozzle that is attached to the lowermost end of the lift pipe (see FIG. 1). With that structure, the flow that is induced into the lift pipe includes water, sediment, plant and aquatic life, and small and large mineral nodules, all of which is carried to the collection barge 16. In the barge a suitable screening means is provided to separate the more desirable larger nodules from the water, sediment, plant and aquatic life and smaller nodules, and the latter are returned to the ocean.

Figure 6:
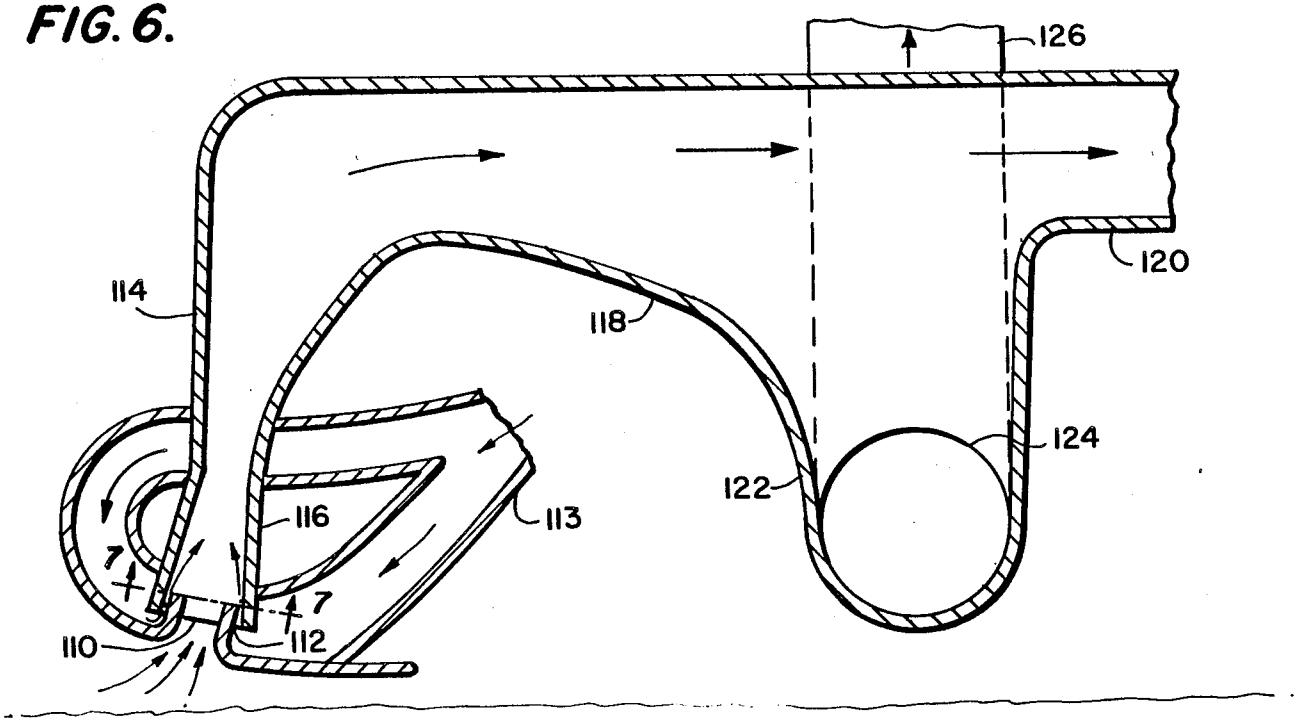
FIG. 6 is a fragmentary sectional view of one form of collection device for lifting and collecting mineral nodules from the ocean floor.
Figure 7:
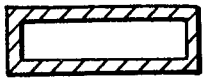
FIG. 7 is a cross-sectional view taken along the line 7—7 of FIG. 6.

An alternative structure for the collection device is illustrated in FIG. 6, in which the separation between the large, desirable nodules and the water, sediment, plant and aquatic life and smaller nodules is effected at the ocean floor. Such an arrangement provides a desirable result in that the sediment and other undesired materials are immediately redeposited on the ocean floor, and they thus do not agitate or cloud the water adjacent the upper surface of the ocean, nor do they disturb the aquatic life at the upper or intermediate levels. Structurally, the alternative collection device includes an elongated opening 110 that has a longer dimension positioned perpendicular to a direction of intended movement of the opening relative to the ocean floor (see FIG. 7) and that is internally bounded by an annular nozzle 112 through which pressurized water is conveyed from conduit 113 to provide a jet pump action adjacent the elongated oening, and thereby provide a reduced pressure area that serves to induce the flow into opening 110 of materials on the ocean floor. The flow of the jet takes place along a conduit 114, which can include a converging-diverging nozzle 116, as shown, and then enters a settling chamber 118, which is in the form of a flow passageway that diverges in the direction of flow to cause a reduction of the flow velocity. The main portion of the flow continues to an outlet 120 from the settling chamber 118 and carries with it the sediment and lighter particles and nodules. A portion of the water, together with the heavier nodules that tend to fall to the lowermost portion of settling chamber 118 and into a nodule collection chamber 122 then pass into a collection pipe 124 that communicates with the lowermost portion of nodule collection chamber 122 and conveys the heavier nodules and water to a lift piper 126. Preferably, the pump (not shown0 that supplies the water to conduit 113, together with the piping shown in FIG. 6, is carried on a sled, or the like, to facilitate movement of the collection device along the ocean floor.

In operation, lift pipe 20 is submerged, along with an instrument platform 26, if desired, and dredge pipe 14 is positioned relative to a collection chamber, which can be in the form of a collection barge 16, as shown in FIG. 1. The water pump 12 is operated to provide the pressurized water and thereby to induce the flow of water and nodules through the lift pipe, into the dredge pipe and into the collection barge. The control of the rate of flow of material through the dredge pipe can be controlled by controlling the speed of the water pump, or of the speed of the ships engine, if that source of power is used, by the positioning of the lift pipe outlet relative to the venturi to control the variable jet annulus area forming a part of the jet pumping chamber, and by the control of the speed of the ship during the mining operation, because the ship will, of necessity, move in order to carry the collection head of the lower end of the lift pipe along the ocean floor.

Although particular embodiments of the present invention have been illustrated and described, it will be apparent to those skilled in the art that various changes and modifications can be made without departing from the spirit of the present invention, and it is intended to encompass inthe appended claims all such changes that fall within the scope of the present invention.

What is claimed:

1. Undersea mining apparatus for recovering particulate matter on the ocean floor, said apparatus comprising:

(a) conduit means for conveying particulate material in the form of nodules from the sea floor to a surface vessel, said conduit means having an inlet end adapted to be positioned adjacent the ocean floor and an outlet end spaced from said inlet end and defining a discharge opening to discharge collected nodules into a surface vessel;

(b) pump means for providing a source of water under pressure;

(c) collecting means connected to said inlet end of said conduit means for collecting nodules and for conveying collected nodules to said conduit means;

(d) lifting means in communication with said pump means and connected to said conduit means for providing a lifting jet of pressurized water to cause said nodules to travel through said conduit means, said lifting means including a submerged lifting chamber surrounding said conduit at a desired height of said conduit means above the sea floor and in communication with said pump means, said conduit means including a lift pipe extending from a point adjacent the ocean floor to said lifting chamber and a dredge pipe extending from said lifting chamber to a surface vessel, said lift pipe communicating with said lifting chamber and having an inlet opening adjacent the ocean floor and extending from the ocean floor and connected to said collecting means, said lift pipe having a parallel wall cylindrical outlet extending within said lifting chamber and efined by a first diameter substantially equal to the lift pipe diameter to define a substantially continuous cylindrical flow passage, said dredge pipe having an inlet within said lifting chamber and adjacent said lifting pipe outlet, said dredge pipe having an outlet positioned to discharge collected material into a surface vessel, said dredge pipe having a venturi including a converging section, a throat section defined by a second diameter smaller than said first diameter and a diverging section, each in axial alignment to provide an axially-symmetric converging-diverging venturi, said lift pipe opening extending into said converging section of said venturi and defining therewith an annulus area therebetween, said annulus area communicating with said lifting chamber to permit pressurized water to pass through said annulus area and into said venturi to provide a pumping effect to lift the nodules through said conduit means to a surface vessel, said lift pipe outlet and said dredge pipe inlet being movable relative to each other to permit varying said annulus area to achieve a desired lifting effect, and moving means for moving one of said lift pipe outlet and said venturi relative to the other for varying said annulus area, whrein said lift pipe outlet is defined by an axially movable collar that is movable into and out of the converging section of the venturi to vary the annulus area, said collar having an internal thread formed on an inner surface thereof and engageable with an external thread formed on an outer surface of said lift pipe, said collar including an external ring gear formed on an outer surface thereof, and said moving means including a drive means and a drive gear rotatably driven by said drive means, said drive gear engageable with said ring gear to rotate said collar to move it axially toward and away from said venturi.

2. Undersea mining apparatus in accordance with claim 1, wherein said venturi is carried in an inner tubular sleeve that is movable axially within and relative to said dredge pipe toward and away from the outlet openign of said lift pipe, said dredge pipe carrying axially movable actuator means externally of said dredge pipe and positioned adjacent said dredge pipe inlet, said actuator means extending within said lifting chamber and being connected with an exterior portion of said sleeve for moving said sleeve axially relative to said dredge pipe and to said lift pipe outlet to vary said annulus area.

3. Undersea mining apparatus in accordance with claim 2, wherein said collecting means includes an elongated opening at the lowermost end of said lift pipe, said elongated opening having a longer dimension positioned perpendicular to a direction of intended movement of said elongated opening relative to the ocean floor and including a surrounding annular nozzle means directed inwardly and generally axially into said opening, settling chamber means in communication with said opening, collecting chamber means positioned at a lowermost portion of the settling chamber means to receive nodules, said collecting chamber means communicating with said lift pipe; and discharge conduit means positioned at an upper portion of said settling chamber means to receive water, sediment, and lighter nodules and material for return to the ocean floor.

4. Undersea mining apparatus in accordance with claim 3, wherein a converging-diverging nozzle means is positioned between said opening and said settling chamber means.

5. Undersea mining apparatus in accordance with claim 3, wherein said settling chamber means includes a flow passageway that diverges in the direction of flow to reduce the flow velocity therethrough, said flow passageway having an axial extent sufficient to permit heavier nodules to fall to the bottom of the settling chamber means, and an outlet to permit outward flow of water, sediment, and lighter nodules to the ocean floor.

6. Undersea mining apparatus in accordance with claim 1, wherein said venturi has a throat section flow area that is about one half the flow area at the outlet of said lift pipe.

7. Undersea mining apparatus in accordance with claim 1, wherein said pipe means includes a pump on an ocean vessel, the pump means being in communication with said lifting means.

8. Undersea mining apparatus in accordance with claim 7, wherein said pump means is defined by a pump impeller means connected with a main propulsion plant output shaft on said ship.

9. Undersea mining apparatus in accordance with claim 1, wherein said collecting means includes an elongated opening at the lowermost end of said lift pipe, said elongated opening have a longer dimension positioned perpendicular to a direction of intended movement of said elongated opening relative to the ocean floor and including a surrounding annular nozzle means directed inwardly and generally axially into said opening, settling chamber means in communication with said opening, collecting chamber means positioned at a lowermost portion of the settling chamber means to receive nodules, said collecting chamber means communicating with said lift pipe; and discharge conduit means positioned at an upper portion of said settling chamber means to receive water, sediment, and lighter nodules and materials for return to the ocean floor.

10. Undersea mining apparatus in accordance with claim 9, wherein a converging-diverging nozzle means is positioned between said opening and said settling chamber means.

11. Undersea mining apparatus in accordance with claim 9, wherein said settling chamber means includes a flow passageway that diverges in the direction of flow to reduce the flow velocity therethrough, said flow passageway having an axial extent sufficient to permit heavier nodules to fall to the bottom of the settling chamber means, and an outlet to permit outward flow of water, sediment, and lighter nodules to the ocean floor.

12. Undersea mining apparatus for recovering particulate matter on the ocean floor, said apparatus comprising:

(a) conduit means for conveying particulate material in the form of nodules from the sea floor to a surface vessel, said conduit means having an inlet end adapted to be positioned adjacent the ocean floor and an outlet end spaced from said inlet end and defining a discharge opening to discharge collected nodules into a surface vessel;

(b) pump means for providing a source of water under pressure;

(c) collecting means connected to said inlet end of said conduit means for collecting nodules and for conveying collected nodules to said conduit means;

(d) lifting means in communication with said pump means and connected to said conduit means for providing a lifting jet of pressuirzed water to cause said nodules to travel through said conduit means, said lifting means incluidng a submerged lifting chamber surrounding said conduit at a desired height of said conduit means above the sea floor and in communication with said pump means, said conduit means including a lift pipe extending from a point adjacent the ocean floor to said lifting chamber and a dredge pipe extending from said lifting chamber to a surface vessel, said lift pipe communicating with said lifting chamber and having an inlet opening adjacent the ocean floor and extending from the ocean floor and connected to said collecting means, said lift pipe having a parallel wall cylindrical outlet extending within said lifting chamber and defined by a first diameter substantially equal to the lift pipe diameter to define a substantially continuous cylindrical flow passage, said dredge pipe having an inlet within said lifting chamber and adjacent said lifting pipe outlet, said dredge pipe having an outlet positioned to discharge collected material into a surface vessel, said dredge pipe having a venturi including a converging section, a throat section defined by a second diameter smaller than said first diameter, and a diverging section, each in axial alignment to provide an axially-symmetric converging-diverging venturi, said lift pipe opening extending into said converging section of said venturi and defining therewith an annulus area therebetween, said annulus area communicating with said lifting chamber to permit pressurized water to pass through said annulus area and into said venturi to provide a pumping effect to lift the nodules through said conduit means to a surface vessel, said lift pipe outlet and said dredge pipe inlet being movable relative to each other to permit varying said annulus area to achieve a desired lifting effect, and moving means for moving one of said lift pipe outlet and said venturi relative to the other for varying said annulus area, wherein said lifting means includes a two-stage jet pump, a first stage positioned at a first elevation relative to the ocean floor, and a second stage positioned at a second elevation relative to the ocean floor, said second elevation spaced vertically from said first elevation, each of said stages including a fixed venturi and an inlet pipe extending thereinto, said inlet pipes each having an axially movable collar, said collar having an internal thread formed on an inner surface thereof and engageable with an external thread formed on an outer surface of said lift pipe, said collar including an external ring gear formed on an outer surface thereof, and said moving means including a drive means and a drive gear rotatably driven by said drive means, said drive gear engageable with said ring gear to rotate said collar to move it axially toward and away from said venturi, and settling tank means positioned between and in communication with said first and second stages of said two-stage jet pump.

13. Undersea mining apparatus in accordance with claim 12, wherein said settling tank means includes pressure control valve means to maintain a desired pressure within said settling tank means and to permit return flow of water from said settling tank means to the ocean and to control flow of water and particles from said second stage to said first stage.

14. Undersea mining apparatus in accordance with claim 12, wherein said collecting means includes an elongated opening at the lowermost end of said lift pipe, said elongated opening having a longer dimension positioned perpendicular to a direction of intended movement of said elongated opening relative to the ocean floor and including a surrounding annular nozzle means directed inwardly and generally axially into said opening, settling chamber means in communication with said opening, collecting chamber means positioned at a lowermost portion of the settling chamber means to receive nodules, said collecting chamber means communicating with said lift pipe; and discharge means positioned at an upper portion of said settling chamber means to receive water, sediment, and lighter nodules and materials for return to the ocean floor.

15. Undersea mining apparatus in accordance with claim 14, wherein a converging-diverging nozzle means is positioned between said opening and said settling chamber means.

16. Undersea mining apparatus in accordance with claim 15, wherein said settling chamber means includes a flow passageway that diverges in the direction of flow to reduce the flow velocity therethrough, said flow passageway having an axial extent sufficient to permit heavier nodules to fall to the bottom of the settling chamber means, and an outlet to permit outward flow of water, sediment, and lighter nodules to the ocean floor.

* * * * *